US008572892B1

(12) United States Patent
Lankford

(10) Patent No.: US 8,572,892 B1
(45) Date of Patent: Nov. 5, 2013

(54) SELF-CLOSING HANGING SYSTEM

(76) Inventor: Mark Lankford, Tyler, TX (US)

( * ) Notice: Subject to any disclaimer, the term of this patent is extended or adjusted under 35 U.S.C. 154(b) by 0 days.

(21) Appl. No.: 13/570,642

(22) Filed: Aug. 9, 2012

(51) Int. Cl.
*E01F 13/00* (2006.01)

(52) U.S. Cl.
USPC ..... 49/49; 49/386; 49/384; 49/236; 49/239

(58) Field of Classification Search
USPC ..... 49/49, 263, 266, 273, 274, 394, 384, 49/386, 236, 237, 238, 239, 364; 256/73
See application file for complete search history.

(56) References Cited

U.S. PATENT DOCUMENTS

| | | | | | |
|---|---|---|---|---|---|
| 189,300 | A | * | 4/1877 | Breakey | 49/238 |
| 225,512 | A | * | 3/1880 | Doolittle | 49/238 |
| 235,113 | A | * | 12/1880 | Young | 49/236 |
| 629,447 | A | * | 7/1899 | Jensen | 110/176 |
| 1,007,306 | A | * | 10/1911 | Nevins et al. | 292/93 |
| 1,126,067 | A | * | 1/1915 | Nolte | 16/307 |
| 1,383,961 | A | * | 7/1921 | Melugin | 16/314 |
| 1,471,830 | A | * | 10/1923 | Corey | 16/72 |
| 1,663,152 | A | * | 3/1928 | Baeth | 292/93 |
| 1,800,165 | A | * | 4/1931 | Waldron | 49/236 |
| 2,086,061 | A | * | 7/1937 | Barr | 49/237 |
| 2,587,287 | A | * | 2/1952 | Chamberlain | 16/72 |
| 2,629,191 | A | | 2/1953 | Koch et al. | |
| 2,693,653 | A | * | 11/1954 | Dean, Jr. | 49/238 |
| 2,713,737 | A | * | 7/1955 | Hawkins | 49/271 |
| 2,742,722 | A | | 4/1956 | Schaefer | |
| 3,193,955 | A | | 7/1965 | Pitts | |
| 3,377,746 | A | * | 4/1968 | Thomas | 49/242 |
| 3,497,996 | A | | 3/1970 | Stevens | |
| 3,683,554 | A | | 8/1972 | Romberg | |
| 3,775,912 | A | * | 12/1973 | Walls | 49/131 |
| 4,145,842 | A | | 3/1979 | Clugston | |
| 4,205,472 | A | * | 6/1980 | Shirley | 40/608 |
| 5,133,152 | A | * | 7/1992 | Grancagnolo | 49/239 |
| 5,138,796 | A | | 8/1992 | Grainger | |
| 6,349,503 | B1 | * | 2/2002 | Gompertz et al. | 49/34 |
| 6,988,719 | B2 | * | 1/2006 | Ursell et al. | 269/289 MR |
| 2011/0193041 | A1 | * | 8/2011 | Stull | 256/73 |

* cited by examiner

*Primary Examiner* — Katherine Mitchell
*Assistant Examiner* — Shiref Mekhaeil
(74) *Attorney, Agent, or Firm* — Eric C. Schmalbach

(57) ABSTRACT

A self-closing hanging system includes an entrance, a base support member located at one side of the entrance, a bearing arrangement attached to the base support member, a support arm attached to the base support member, a bumper assembly defined by at least one bumper frame member pivotably fastened to the gate surface member at a gate fulcrum, an at least one bumper contact element fastened to the at least one bumper frame member, the at least one bumper contact element is capable of axial rotation about the at least one bumper frame member, and a counter-balance assembly extending from the first bumper frame member to the second bumper frame member.

17 Claims, 19 Drawing Sheets

SELF-CLOSING HANGING SYSTEM

CROSS REFERENCE TO RELATED APPLICATIONS

This application contains subject matter related to subject matter contained in co-pending U.S. Ser. No. 13/570,582 filed on Aug. 9, 2012 and incorporated herein by reference.

BACKGROUND

Regulated and time-efficient passage through an entrance continues to be a problem. Entry systems traditionally provide a means of passage to a closed, or fenced in area. Such entry systems are typically maintained in a closed and latched position to prohibit or restrict entrance. Operation of entry systems often requires egress of a driver from a vehicle to operate the entry system. The driver must exit the vehicle to operate the entry system, thereby expending time during operation.

Self-regulating gating systems are known which employ bumper assemblies activated by a vehicle. However, bumper assemblies may strike or damage a vehicle during passage. Bumper assemblies can often be unintentionally activated by wind or livestock. Moreover, the excess weight of bumper assemblies exerts increased load pressures on hinge assemblies, resulting malfunction and damage. Therefore, a need exists for an improved self-closing hanging system which allows regulated and time-efficient passage through an entrance.

SUMMARY

The present invention is directed towards an improved self-closing hanging system for regulated and time-efficient passage through an entrance. The self-closing hanging system includes an upright support post, which has a cam surface. A post member is concentrically disposed within the upright support post, extending at an opposing end to a receiver member. At least one bearing member extends from the post member as follower to the cam surface. A hinge post extends parallel with the upright support post, separated a distance from the upright support post, and inserted at its upper end into the receiver member. A support arm is inserted into the receiver member. A hinge bearing structure is located between the hinge post and upright support member. The upright support post is filled with a fluid. A bumper hanging assembly is attached to the upright support post. A bumper assembly is attached to the bumper hanging assembly. The bumper assembly defines a first bumper frame member attached to a fulcrum, a first bumper contact element capable of independent axial rotation in relation to the first bumper frame member, a second bumper frame member attached to the fulcrum, a second bumper contact element capable of independent axial rotation in relation to the second bumper frame member. The first bumper frame member and second bumper frame member exist as a contiguous assembly, forming a lever capable of rotation about the fulcrum, as a continuous force is applied to either of the first bumper contact element or second bumper contact element in during opening. The fulcrum is located on the bumper hanging assembly. A counter-balance assembly extends from the first bumper frame member to the second bumper frame member, causing opposing axial rotation between the first bumper frame member and the second bumper frame member. The counter-balance assembly further causes the first bumper frame member to maintain a first central angle between the entrance member which approximately equivalent to a second central angle between the second bumper frame member and the support arm. A reset mechanism extends between the bumper hanging assembly and bumper assembly, causing the position of the bumper assembly relative to the support arm to reset when the force is removed from either the first bumper contact element or second bumper contact element.

BRIEF DESCRIPTION OF THE DRAWINGS

These and other features, aspects and advantages of embodiments of the invention will become better understood with regard to the following description, appended claims, and accompanying drawings where:

DETAILED DESCRIPTION

Figure 1:
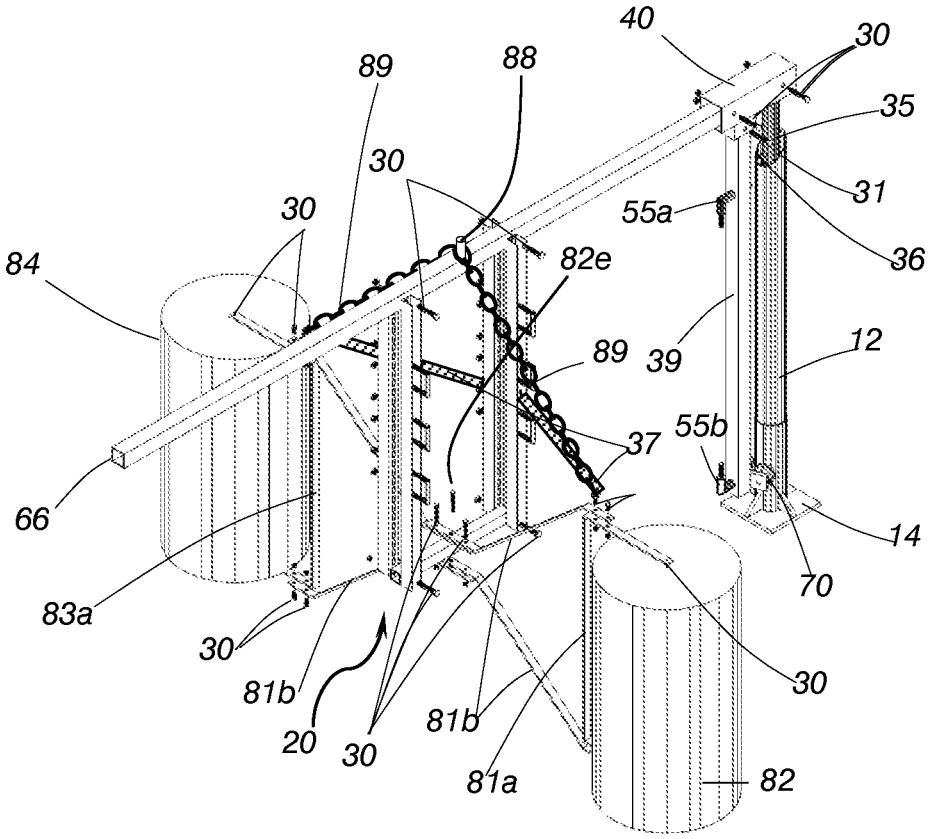
FIG. 1 is a partially exploded perspective view of a self-closing hanging system of an embodiment of the invention.
Figure 2:
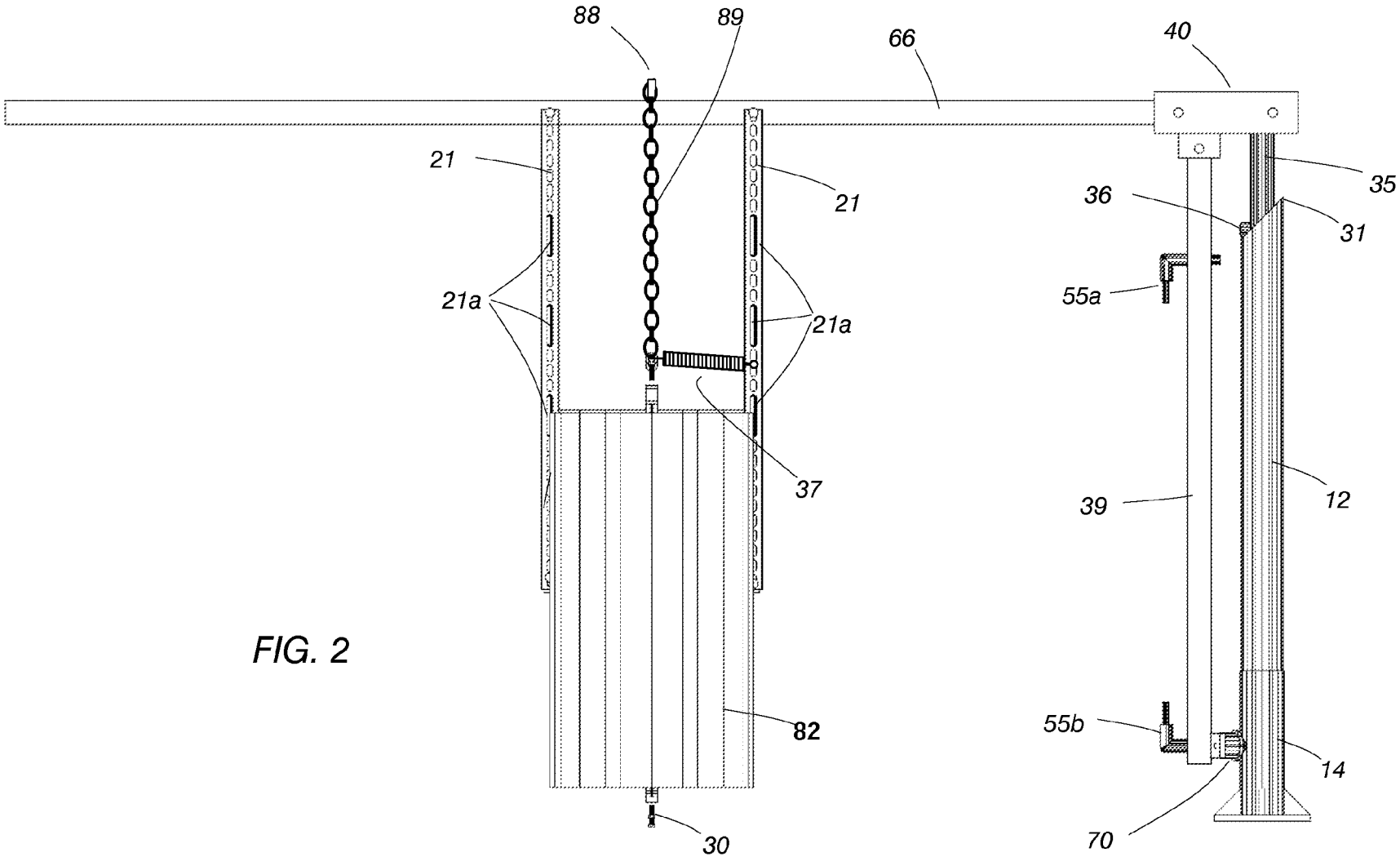
FIG. 2 is a front view of a self-closing hanging system, according to the embodiment of FIG. 1.
Figure 3:
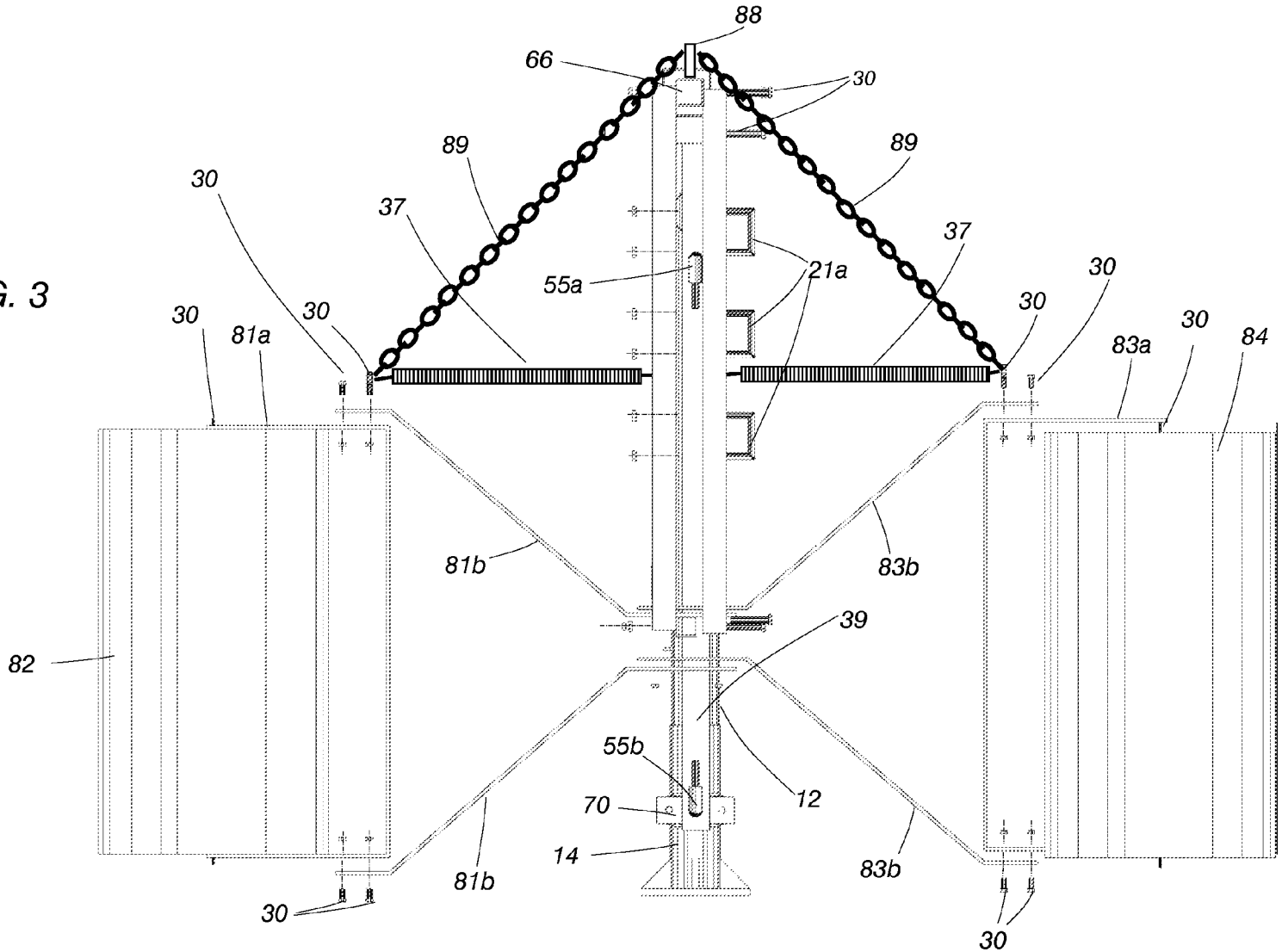
FIG. 3 is a partially exploded side view of a self-closing hanging system, showing the bumper assembly in a first rest position, according to the embodiment of FIG. 1.
Figure 4:
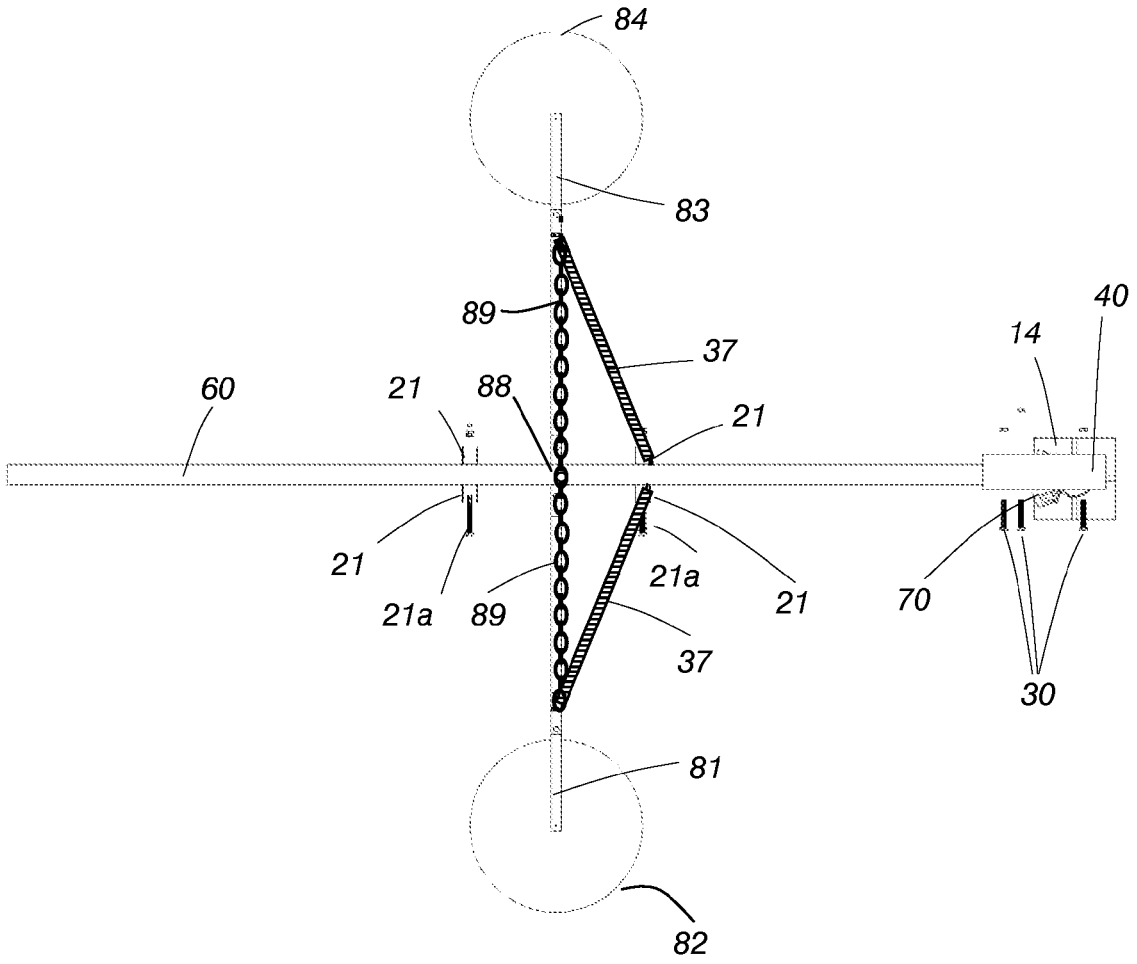
FIG. 4 is a partially exploded top plan view of a self-closing hanging system, showing the bumper assembly in a first reset position, according to the embodiment of FIG. 1.
Figure 5:
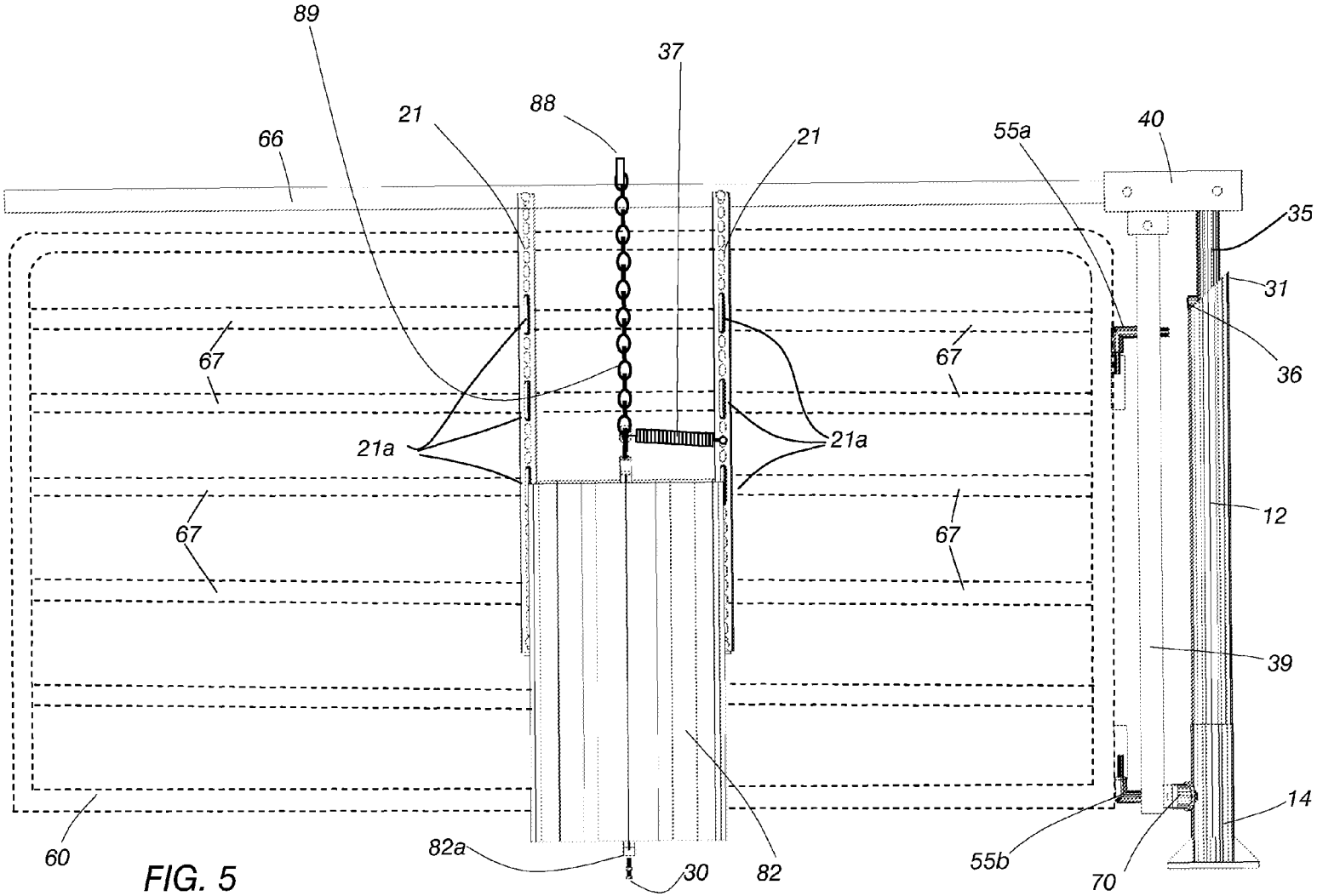
FIG. 5 is a front view of a gate system, showing the self-closing hanging system attached to a gate, according to the embodiment of FIG. 1.

Referring to FIGS. 1-5, upright support post 12 extends longitudinally perpendicular relative to the ground. Upright support post 12 is a hollow rigid body, and is fixedly set into a foundation member 14. Foundation member 14 is fixedly set into the ground. Upper cam surface 31 is located at the upper terminus of upright support post 12, presenting an upwardly helical surface, serving as a cam body. Post member 35 is a longitudinally extending member, concentrically disposed within upright support post 12 at one end of the post member 35, and into a receiver member 40 at an opposing end of the post member 35. Roller bearing 36 is fixedly attached to post member 35, such that roller bearing 36 extends longitudinally perpendicular from post member 35. Roller bearing 36 axially rotates, acting as cam follower. Roller bearing 36 travels along upper cam surface 31 during operation. Hinge post 39 extends longitudinally parallel with upright support post 12 at an offset distance from upright support post 12.

Referring to FIGS. 1-5, receiver coupler element 40 is a rigid connection post defining a longitudinally extending receiver body 41. The receiver element is a rigid "T" shaped connection. Receiver coupler element 40 receives the post member 35, hinge post 39, and support arm 66. Components are fixedly held in place by one or more set bolts 30.

Support arm 66 extends longitudinally perpendicular from hinge post 39. An entrance member 60 (such as a gate, or cattle guard, for example) may be attached by an attachment means. Attachment means of the preferred embodiment comprises a set of j-bolts 69*a*, 69*b* securably fastening entry member 60 to entrance support arm 66. The entrance member 60 of the preferred embodiment illustrates a structure with a number of support beams 67. However, any type of suitable entry member may be substituted.

Figure 14:
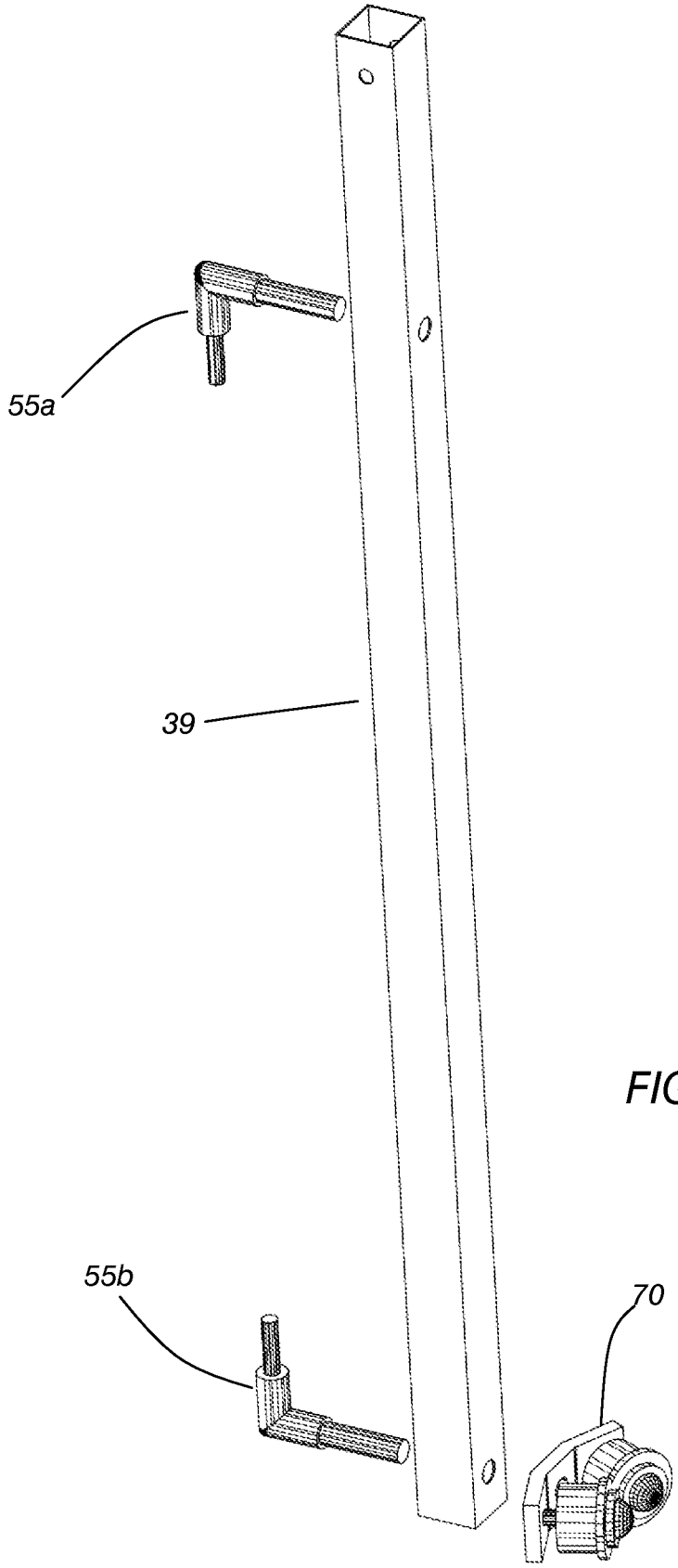
FIG. 14 is an exploded perspective view of a hinge post, a hinge bearing structure, and attachment means, according to the embodiment of FIG. 1.
Figure 15:
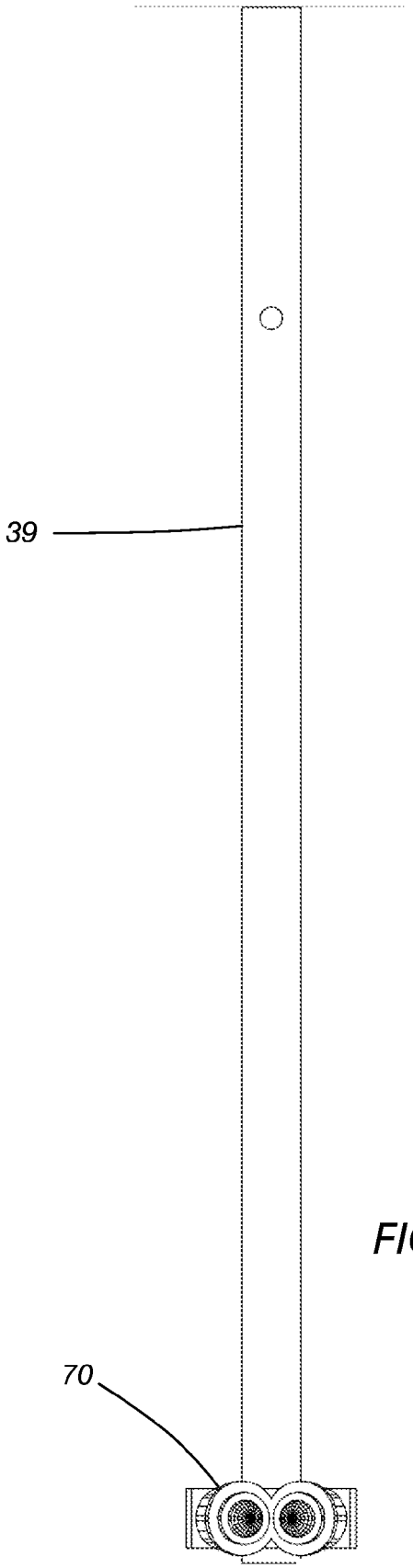
FIG. 15 is a side view of a hinge post and a hinge bearing structure, according to the embodiment of FIG. 1.
Figure 18:
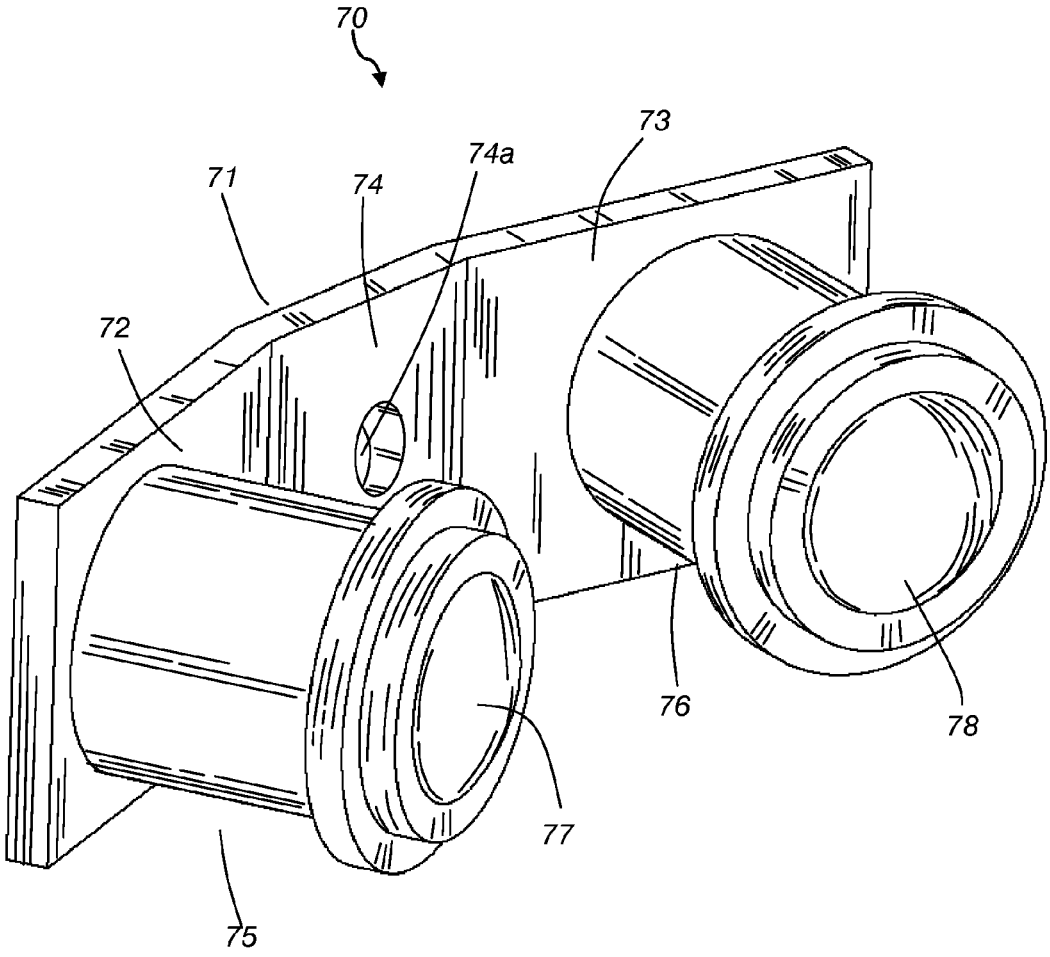
FIG. 18 is a perspective view of a hinge bearing structure according to the embodiment of FIG. 1.

Referring to FIGS. 1-5, hinge bearing structure 70 is located between hinge post 39 and upright support post 12. Hinge bearing structure 70 has a rigid support strut 71 fixedly attached to hinge post 39, and linear ball transfer bearings 75, 76 fixedly mounted onto rigid support strut 71. As shown in detail in FIG. 14-15, 18, rigid support strut 71 is has longitudinally extending frame bars 72, 73, forming a dihedral angle about a central surface 74. Central surface 74 has surface aperture 74*a* for attachment of hinge bearing structure 70 to hinge post 39. Linear transfer bearings 75, 76 are fixedly attached to each longitudinally extending frame bars 72, 73, such that ball contact surfaces 77, 78 rest against upright support post 12. During opening/closing of entrance member 60, ball contact surfaces 77, 78 rotate around upright support post 12.

Figure 11:
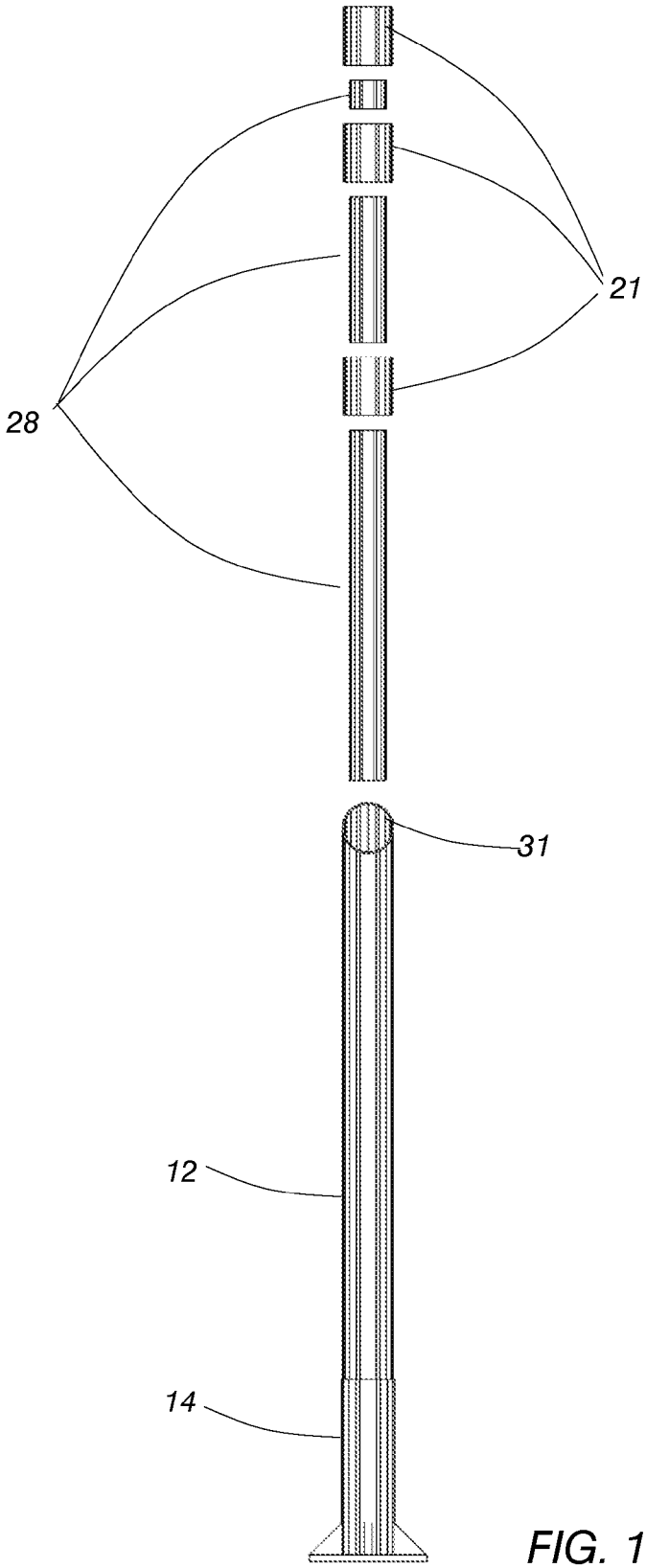
FIG. 11 is an exploded front view of an upright support post, a foundation member, an at least one bearing member, a post member, an at least one linear bearing, and spacers, according to the embodiment of FIG. 1.
Figure 12:
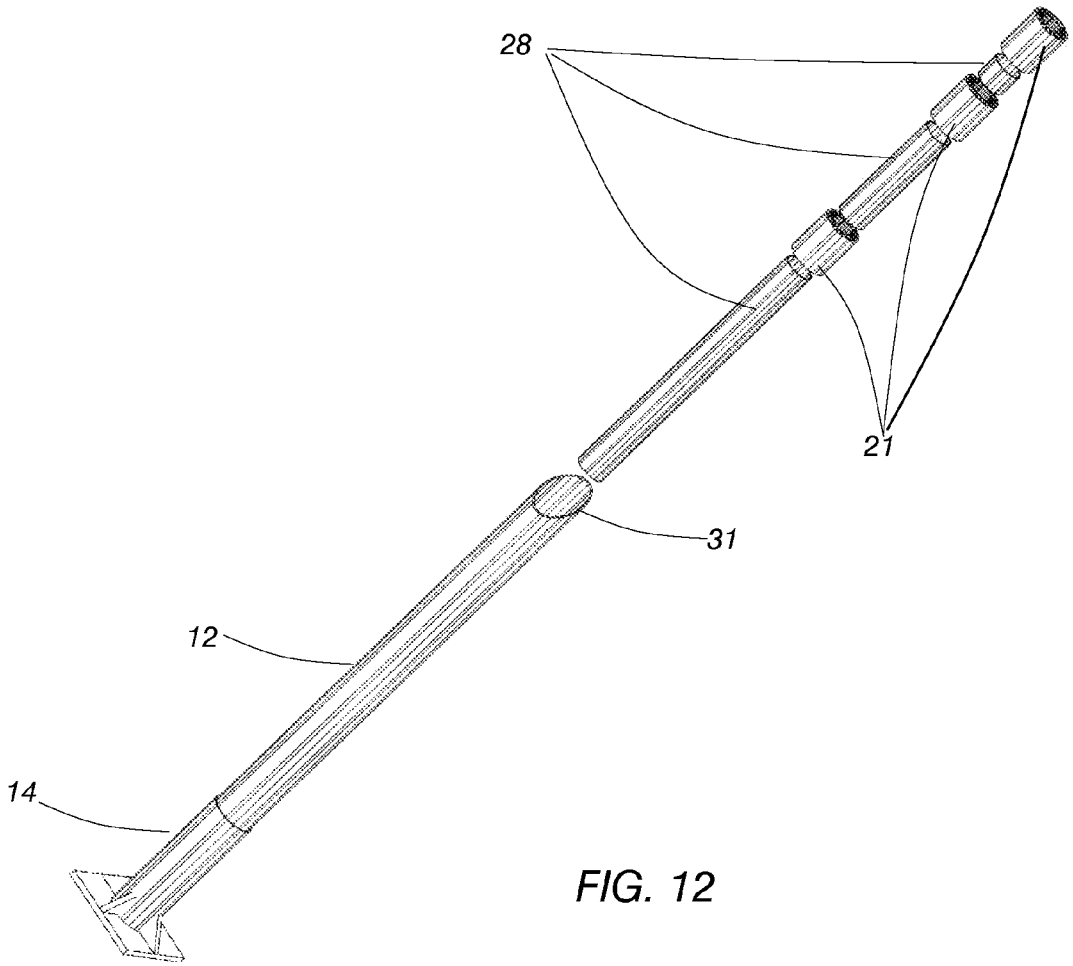
FIG. 12 is an exploded perspective view of an upright support post, a foundation member, an at least one bearing member, a post member, an at least one linear bearing, and spacers, according to the embodiment of FIG. 1.
Figure 16:
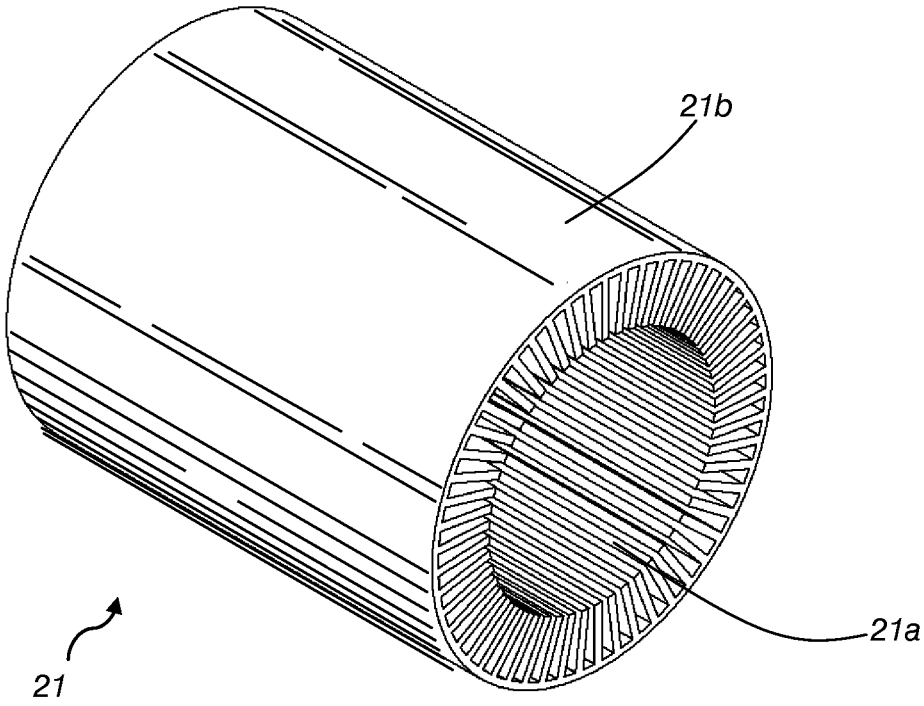
FIG. 16 is a perspective view of a linear bearing according to the embodiment of FIG. 1.
Figure 17:
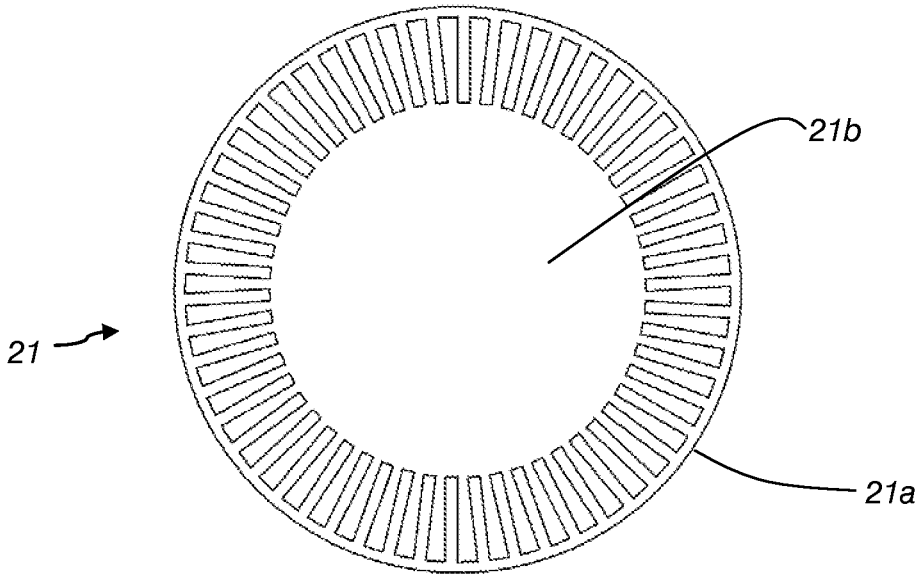
FIG. 17 is a top view of a linear bearing according to the embodiment of FIG. 1.

Referring to FIG. 11 and FIG. 12, at least one linear bearing 21 is disposed within upright support post 12, distributing weight along upright support post 12 during opening/closing of entrance member 60. The preferred embodiment has three linear bearings 21, (however, differing numbers or combinations and types of linear bearing structures are contemplated) concentrically disposed within upright support post 12. Each linear bearing 21 has bearing cavities 21*b* and bearing outer surfaces 21*a*, as shown in FIGS. 16-17. Post member 35 depends through bearing cavities 21*b*, and bearing outer surfaces 21*a* make contact with upright support post 12. According to the embodiment, linear bearings 21 are set along the distance of upright support post 12, and set apart from each other by one or more spacers 38. Spacers 38 are resilient cylindrical members, concentrically disposed within upright support post 12. Post member 35 depends through spacers 38, as shown in FIG. 11 and FIG. 12. The preferred embodiment shows the use of linear bearings, however differing types of bearings may be used. For example, a plain bearing, a rolling element bearing, a jewel bearing, or a fluid bearing may also be used.

Upright support post 12 is filled with a fluid 28. The fluid 28 of the preferred embodiment is a viscous lubricant serving to further distribute point load pressures. The fluid 28 also acts to reduce friction between upright support post 12 and bearing outer surfaces 21*a*. In the preferred embodiment, fluid 28 is a colligative agent such as ethylene glycol. However, other suitable fluids may be used.

Figure 9:
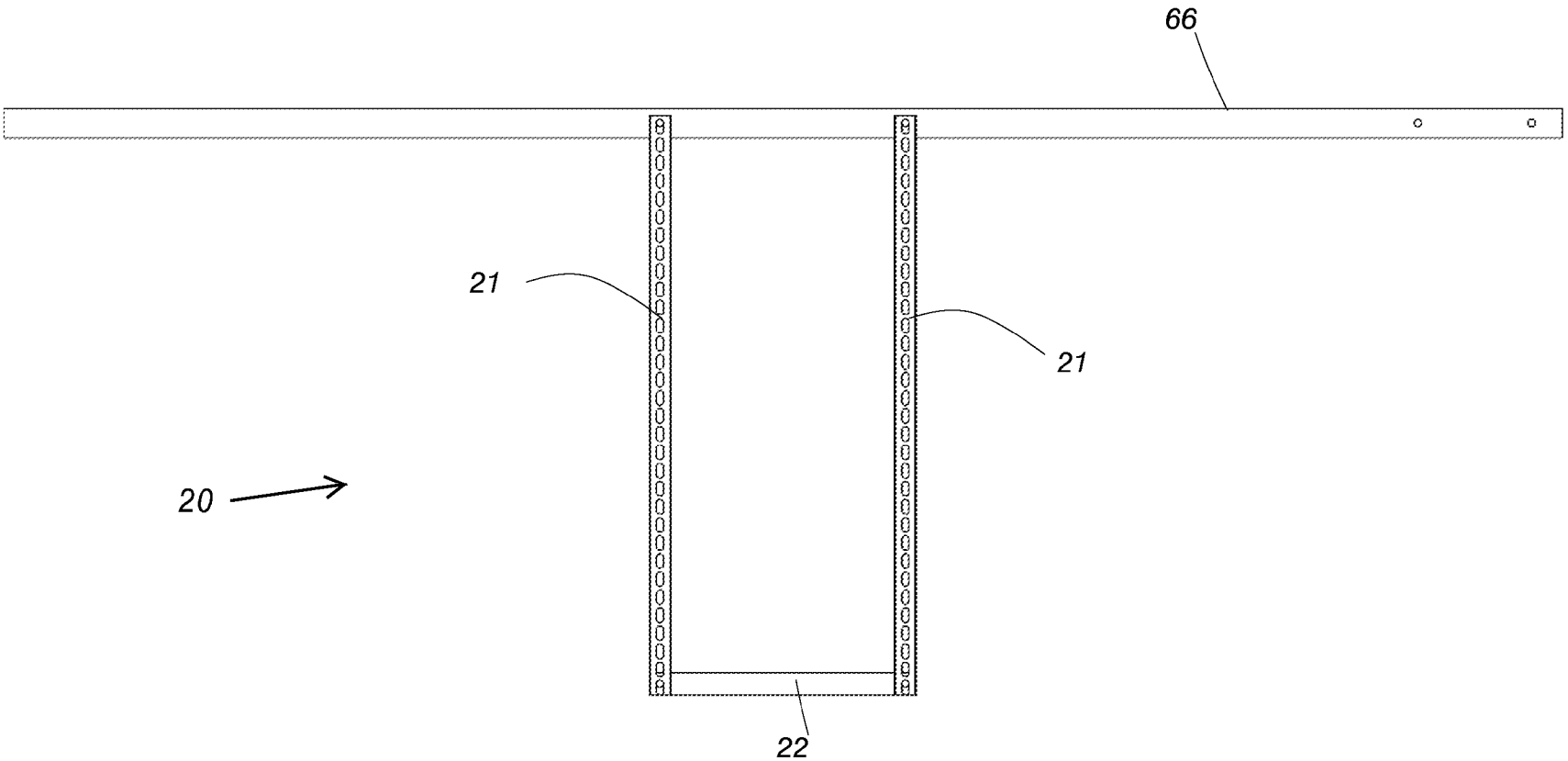
FIG. 9 is a front view of a bumper hanging assembly, according to the embodiment of FIG. 1.
Figure 10:
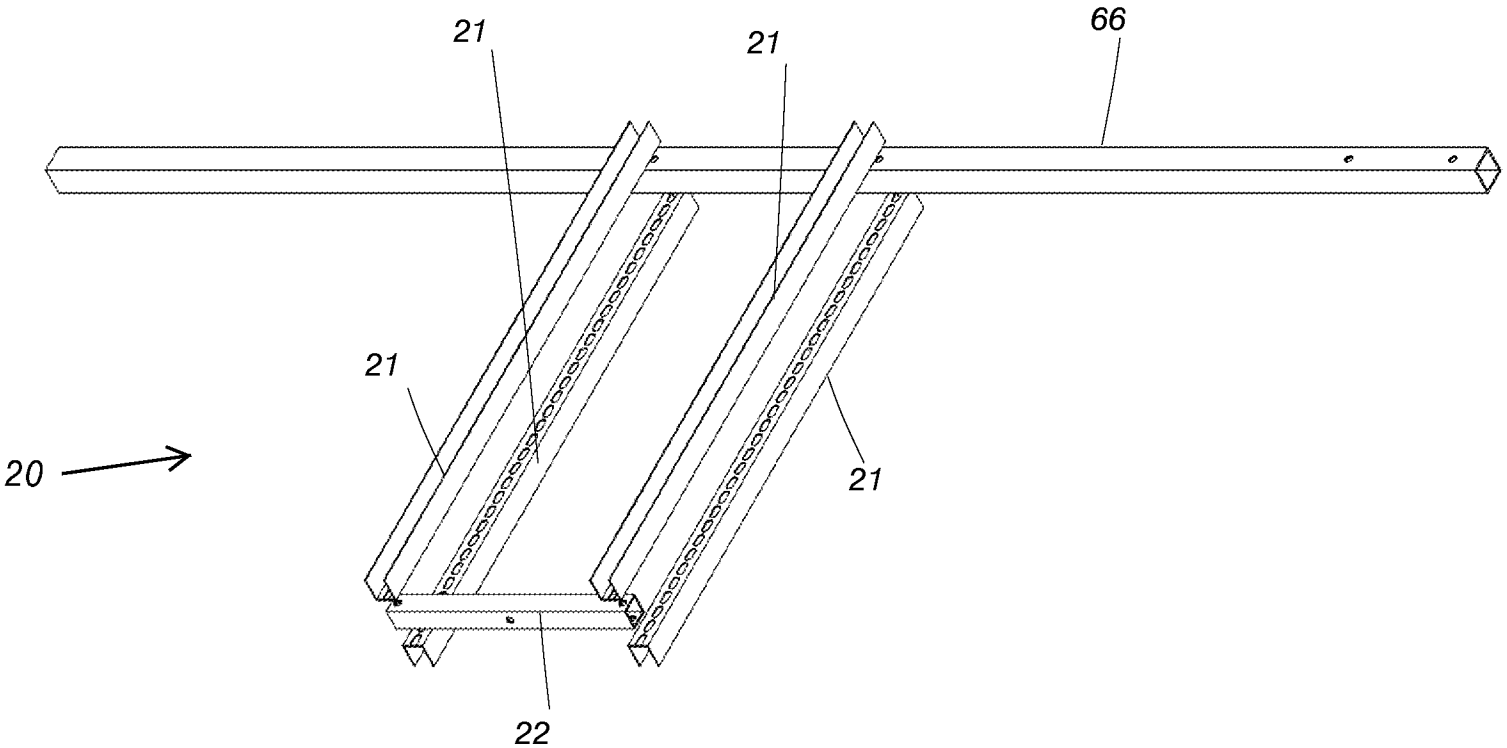
FIG. 10 is a perspective view of a bumper hanging assembly, according to the embodiment of FIG. 1.

Referring to FIG. 9 and FIG. 10, bumper hanging assembly 20, comprises one or more support members 21, depending from support arm 66. Support members 21 are attached to support arm via set bolts 30. One or more U-Bolt members 21*a* may fixably attach entrance member 60 to support members 21. Cross-beam member 22 extends longitudinally between support members 21, and providing longitudinal support. One or more set bolts 30 may be used for attachment.

Referring to FIGS. 1-8, a bumper assembly 80 actuates opening/closing of the support arm 66. Bumper assembly 80 has a first bumper frame member 81 pivotably attached to a fulcrum 86, a first bumper contact element 82 capable of independent axial rotation in relation to first bumper frame member 81, a second bumper frame member 83 attached to fulcrum 86, and a second bumper contact element 84 capable of independent axial rotation in relation to second bumper frame member 83. First bumper contact element 82 and second bumper contact element 84 are cylindrical rollers, capable of axial rotation about axes members 82*a*, 84*a*.

Figure 13:
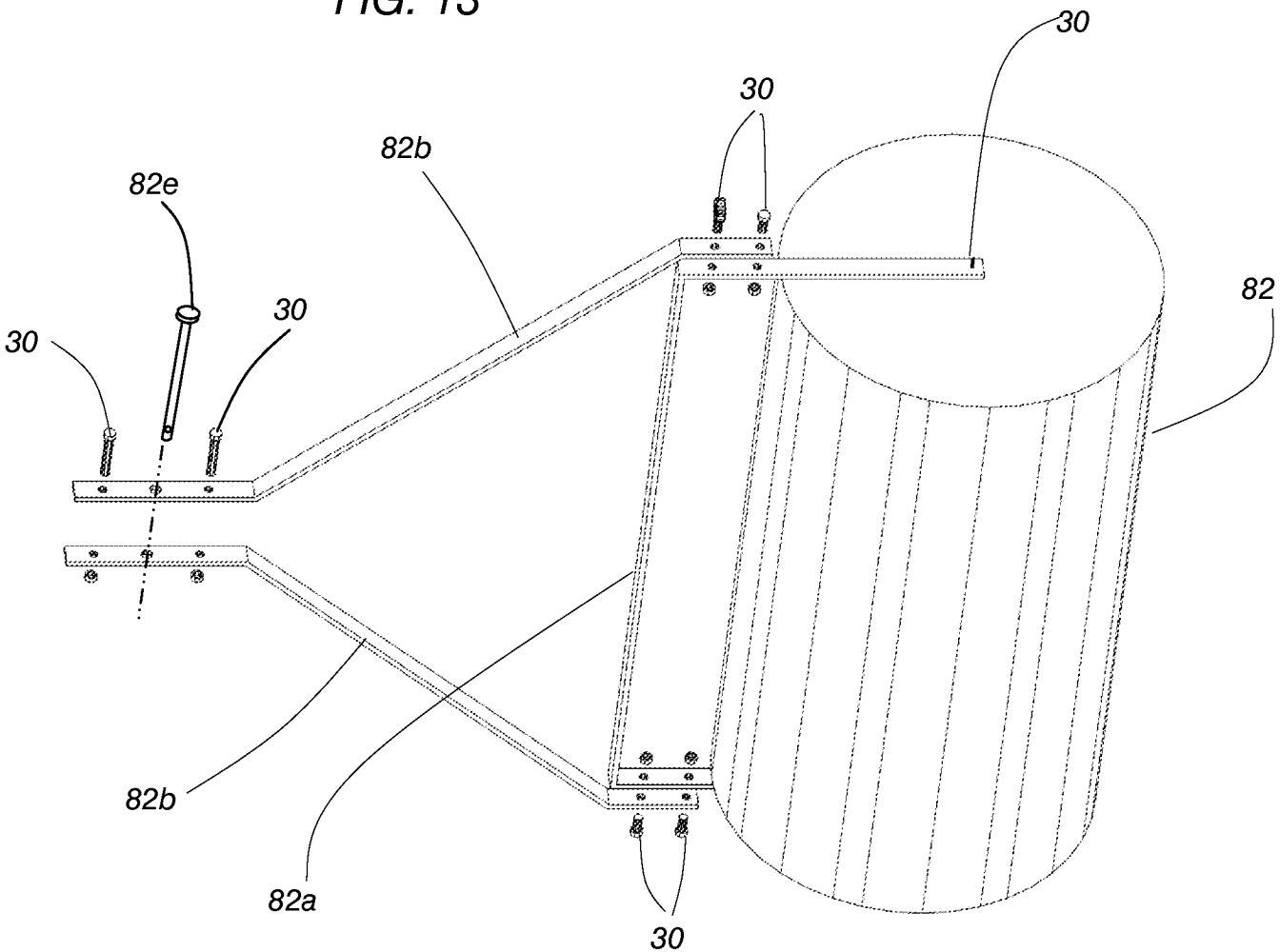
FIG. 13 is an exploded perspective view of a first bumper frame member, and first bumper contact element, according to the embodiment of FIG. 1.

First and second Bumper frame members 81, 84 have one or more upright frame members 81*a*, 83*a*, and one or more traverse members 81*b*, 83*b*. A clevis pin 82*e* rotatably attaches first and second bumper frame members 81, 84 to fulcrum 86. In the preferred embodiment, fulcrum 86 is located at the approximate center of bumper hanging assembly 20, as shown in FIG. 1 and FIG. 13.

Figure 6:
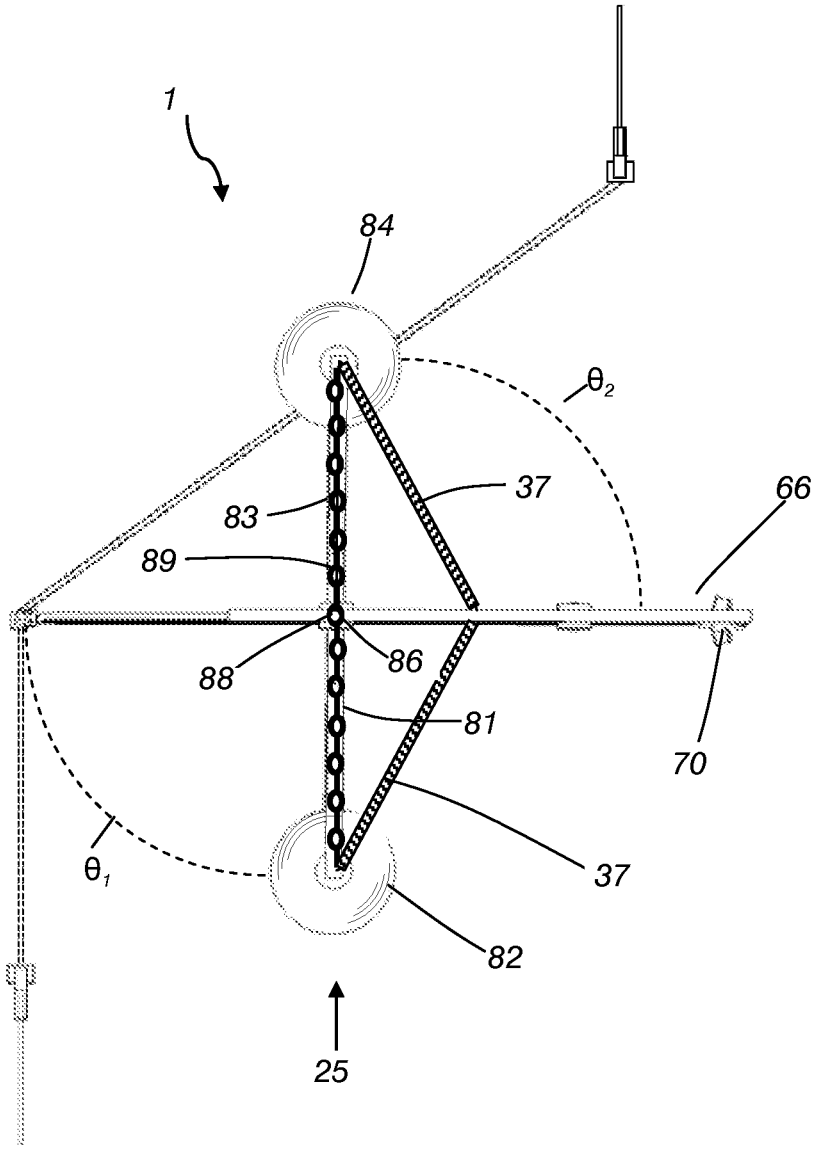
FIG. 6 and FIG. 6A are top plan views of a self-closing hanging system, showing the bumper assembly in a first reset position, according to the embodiment of FIG. 1.
Figure 6A:
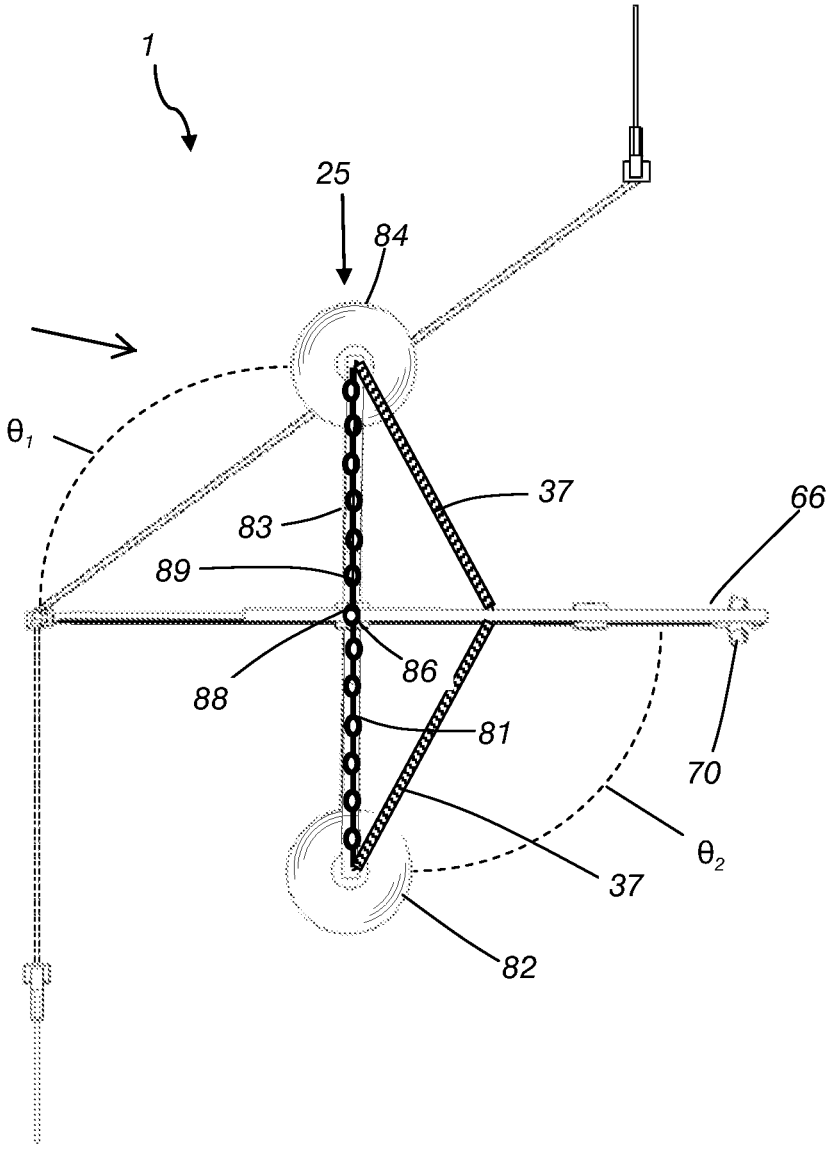
Figure 7:
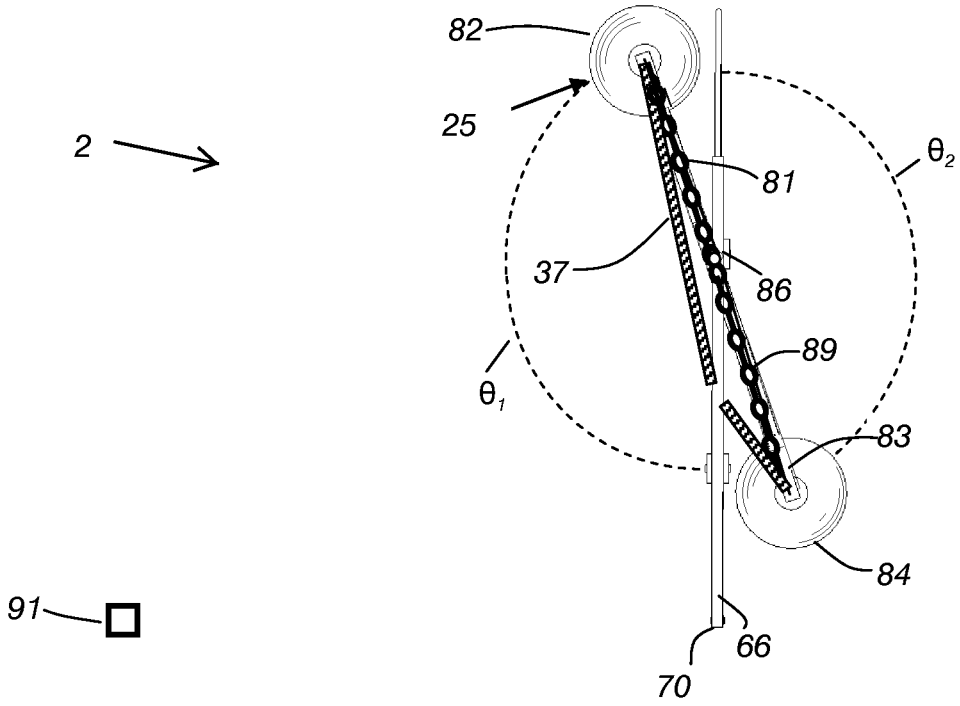
FIG. 7 and FIG. 7A are top plan views of a self-closing hanging system, showing the bumper assembly in a second rotatable position, according to the embodiment of FIG. 1.
Figure 7A:
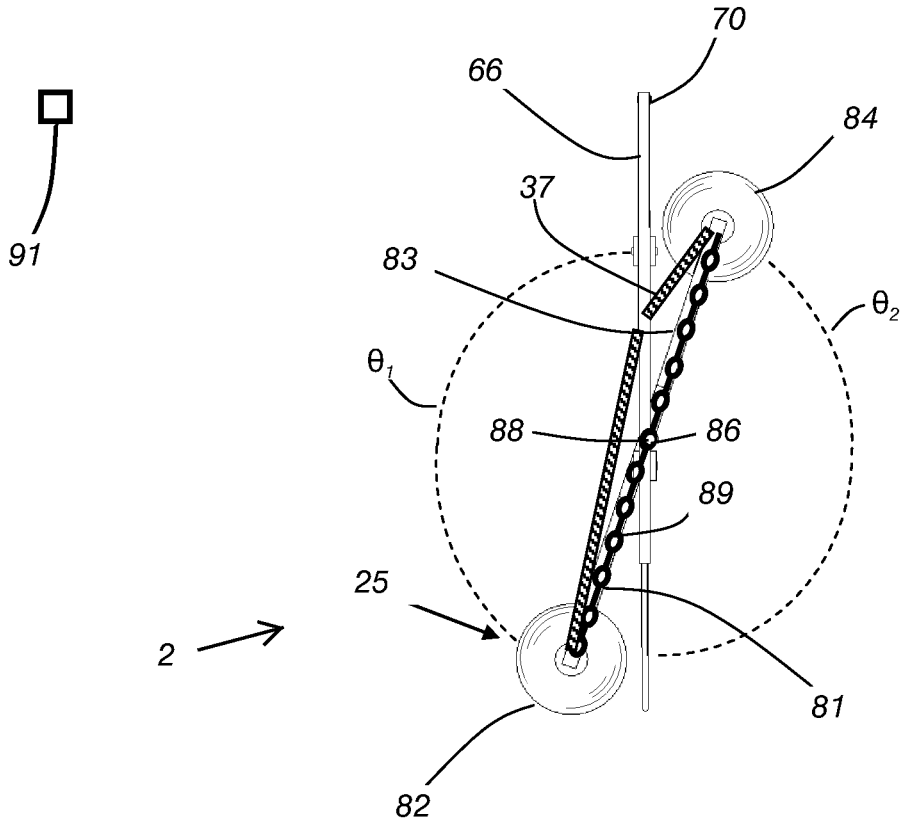
Figure 8:
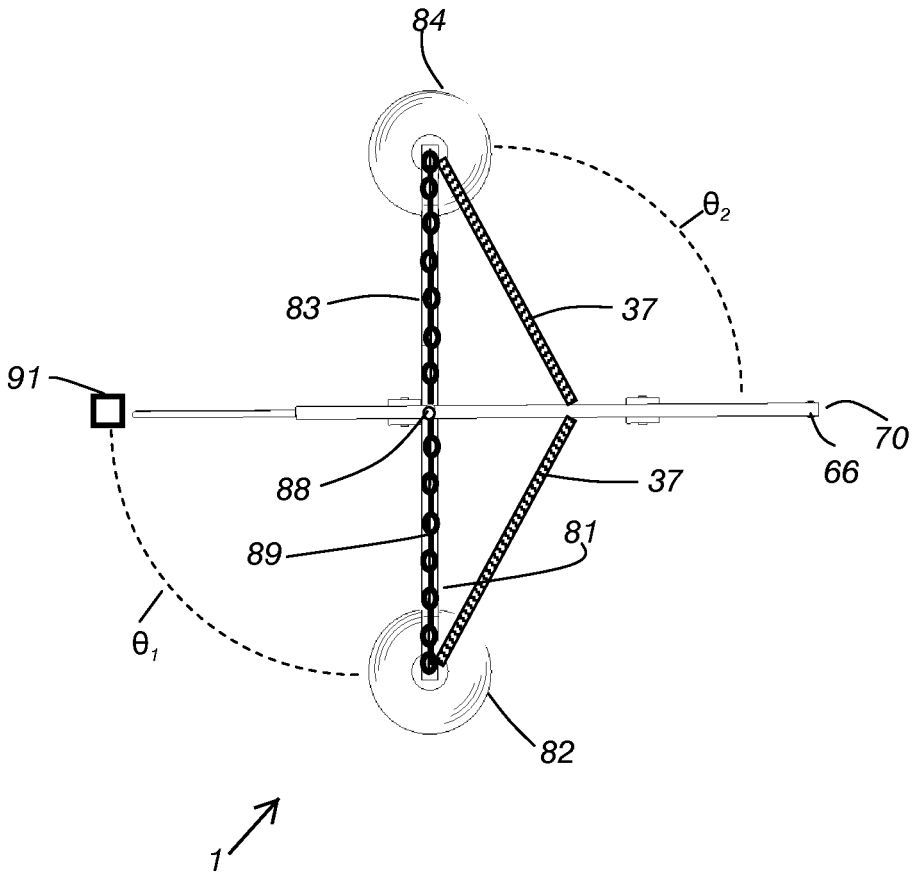
FIG. 8 is a top plan view of a gate system, showing the bumper assembly in a first reset position, according to the embodiment of FIG. 1.

Relative motion of bumper assembly 80 with respect to support arm 66 is illustrated in FIGS. 6-8. Application of a continuous force 25 (such as a force induced by a vehicle) against first bumper contact element 82, causes first bumper contact element 82 to axially rotate with respect to axis member 82*a*. Further application of a force 25 causes first bumper frame member 81 to pivotably rotate about fulcrum 86 from a first reset position 1 (as shown in FIG. 6) to a second rotatable position 2 (as shown in FIG. 7) thereby moving support arm 66 to an open position. As shown, application of the force 25 is approximately tangent to the outer surface of first bumper contact element 82 during such movement. Such a force 25 can be applied by a longitudinally extending surface passing through the entrance, such as that applied by the side of a vehicle. Removal of force 25 against first bumper contact element 82 causes first bumper frame member 81 to pivotably rotate from second rotatable position 2 to said first reset position 1, thereby moving support arm 66 and entrance member 60 back to a closed position (as shown in FIG. 8). As shown in FIG. 6A and FIG. 7A, application of a force 25 against second bumper contact element 84 causes opposing movement of support arm 66 and entrance member 60.

First bumper frame member 81 and said second bumper frame member 83 exist as a contiguous assembly, forming a simple lever capable pivoting about fulcrum 86. Counter-balance assembly 89, extends from first bumper contact element 82 to second bumper contact element 84, through pivot member 88. Counter-balance assembly 89 is an elongate tensile structure. In the preferred embodiment, counter-balance assembly 89 is a metal chain. However, counter-balance assembly 89 may be other types of suitable tensile structures, such as elastic cable, for example. Tension of counter-balance assembly 89 causes opposing axial rotation between first bumper frame member 81 and second bumper frame member 83. As illustrated in FIGS. 6-8, counter-balance assembly 89 causes first bumper frame member 81 to maintain a first central angle $\theta_1$ relative to support arm 66 which approximately equivalent to a second central angle $\theta_2$ between second bumper frame member 83 and support arm 66 during opening/closing.

Referring to FIGS. 1-8, a reset mechanism 37 extends between the bumper hanging assembly 20 and bumper assembly 80, causing the bumper assembly 80 to reset when said force 25 is removed from either the first bumper contact element 82 or second bumper contact element 84. In the preferred embodiment, reset mechanism 37 is a pair of longitudinally extending springs.

Embodiments of the invention may be used for entrance of a vehicle through the gate system. In the example of passage of a vehicle, the support arm 66 first exists in a first reset position 1 (as shown in FIG. 8).

Vehicle continues to move forward, as bumper contact member 82 axially rotates along periphery of vehicle. Second bumper frame member 83 and second bumper contact member 84 rotate in the opposite direction (in relation to first bumper frame member 81 and first bumper contact element 82) such that weight of bumper assembly 80 is distributed evenly with respect to fulcrum 86, thereby preventing weight from increasing support arm 66 acceleration towards the vehicle during closing.

Vehicle continues forward, as roller bearing 36 travels along upper cam surface 31, thereby causing support arm 66 to swing open in relation to support post 12. As vehicle continues forward, first bumper contact member 82 rolls against outer periphery of vehicle until vehicle has exited, at which support arm is in second rotatable position 2 (as shown in FIG. 7).

After vehicle exit, bumper assembly 80 then begins to rotate back to first reset position 1 (as shown in FIG. 8). Even distribution of weight of bumper assembly 80 relative to fulcrum 86 permits bumper assembly 80 to return to first reset position 1 in a controlled manner, without striking the vehicle. Hinge bearing structure 70 limits rate of movement of support arm 66 relative to upright support post 12. Linear bearings 21 further distribute weight of support arm 66 and attached components across length of upright support post 12. Fluid 28 within upright support post 12, reduces friction.

The advantage of the foregoing structure allows operation in a controlled manner, without damaging the vehicle. The placement, type, and composition of equivalent components can be substituted as necessary to control the rate of axial rotation of the support arm and attached gate towards a closed position.

As one bumper contact element and bumper frame member rotates with the vehicle, the opposing bumper contact element and bumper frame member oppositely rotate with respect to support arm. Such opposite rotation distributes the weight of the entire bumper assembly, such that the bumper assembly does not easily return and strike the vehicle.

The hinge bearing arrangement reduces the angular momentum of the entrance member during opening and closing, thereby preventing the bumper assembly from striking the vehicle. Such an arrangement also allows regulated time of the vehicle time for passage.

Incorporation of bearings (such as linear bearings) along the upright support post restricts shearing forces and distributes point loads exerted at the cam surface. The bearings also reduce angular velocity of post member, thereby allowing smooth operating of the support post. Fluid within the upright support post reduces friction with the post member.

Opening of the support arm requires continuous application of a force across bumper surfaces. A vehicle must continue to axially rotate the bumper assembly for the support arm to open. As such, a quick introduction of a force (such as a force introduced by livestock) at the bumper assembly will not cause the support arm to open. Moreover, bumper surfaces extend in a curvilinear manner, limiting the number of wind catching surfaces.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A self-closing hanging system comprising:

an entrance member comprising one or more support beams;

an at least one base support member serving as an outer frame element for said self-closing hanging system located at one side of said entrance member, said at least one base support member defining an upright support post, said upright support post having an at least one cam surface;

a post member concentrically disposed within said upright support post at one end of said post member, and extending at an opposing end of said post member to a receiver member, said post member having an at least one post bearing, said at least one post bearing sliding along said at least one cam surface as a cam follower between opening and closing of said self-closing hanging system;

a hinge post extending parallel with said upright support post and extending at one end of said hinge post into said receiver member;

a support arm mounted to said hinge post, and extending into said receiver member, wherein said support arm extends longitudinally perpendicular from said hinge post;

a hinge bearing structure positioned between said hinge post and said upright support post;

a bearing arrangement positioned between said upright support post and said post member;

a bumper assembly comprising a first bumper frame member attached to a fulcrum, a first bumper contact element capable of independent axial rotation in relation to said first bumper frame member, a second bumper frame member attached to said fulcrum, a second bumper contact element capable of independent axial rotation in relation to said second bumper frame member, wherein said first bumper frame member and said second bumper frame member exist as a contiguous assembly, forming a lever capable of pivoting about said fulcrum;

a counter-balance assembly, causing opposing axial rotation between said first bumper frame member said second bumper frame member, said counter-balance assembly further causing said first bumper frame member to maintain a first central angle between said support arm which approximately equivalent to a second central angle between said second bumper frame member and said support arm, wherein application of a force against said bumper assembly pivotably rotates said bumper assembly about said fulcrum from a first reset position to a second rotatable position thereby moving said self-closing hanging system to an open position of said self-closing hanging system; and a reset mechanism capable of resetting said bumper assembly when said force is removed from said bumper assembly; and a bumper hanging assembly comprising pairs of support members extending downwardly from said support arm, wherein said entrance member extends from said hinge post between said pairs of support members;

a cross beam member extending perpendicularly between a respective pair of said support members, wherein said fulcrum is located on said cross beam member; and a plurality of apertures located on said support members, wherein a fastening structure is inserted through a respective pair of said apertures, securing said respective pair of said support members together, with said support beams disposed there between.

2. The self-closing hanging system of claim 1, wherein said bearing arrangement is a linear bearing.

3. The self-closing hanging system of claim 1, wherein said bearing arrangement is: a plain bearing; a rolling element bearing; a jewel bearing; or a fluid bearing.

4. The self-closing hanging system of claim 1, wherein said bearing arrangement comprises three linear bearings, offset within said upright support post by a plurality of spacers.

5. The self-closing hanging system of claim 1, wherein said hinge bearing structure has a rigid support strut fixedly attached to said upright support post, a pair of linear ball transfer bearings fixedly attached to said rigid support strut, wherein said rigid support strut has longitudinally extending frame bars forming a dihedral angle about a central surface, said pair of linear ball transfer bearings fixedly attached to said longitudinally extending frame bars.

6. The self-closing hanging system of claim 1, wherein said upright support post is filled with a fluid.

7. The self-closing hanging system of claim 1, wherein said reset mechanism is attached between said bumper assembly and said bumper hanging assembly.

8. The self-closing hanging system of claim 1, wherein said counter-balance assembly extends between said first bumper frame member and said second bumper frame member through a pivot member.

9. The self-closing hanging system of claim 8, wherein said counter-balance assembly is a chain.

10. The self-closing hanging system of claim 8, wherein said counter-balance assembly is a system of elastic cables.

11. A self-closing hanging system comprising:

an entrance;

a base support member serving as an outer frame element for said self-closing hanging system located at one side of said entrance;

an entrance member comprising one or more support beams pivotably mounted to said base support member about a hinge bearing structure wherein said hinge bearing structure is capable of regulating a time of travel of said entrance member between open and closed positions of said self-closing hanging system;

a bumper assembly defined by at least one bumper frame member pivotably fastened to said entrance member at a fulcrum, at least one bumper contact element fastened to said at least one bumper frame member, and wherein said at least one bumper contact element is capable of axial rotation about said at least one bumper frame member;

wherein application of a force against said at least one bumper contact element pivotably rotates said at least one bumper frame member about said fulcrum from a first reset position to a second rotatable position thereby moving said self-closing hanging system to an open position of said self-closing hanging system; and wherein removal of said force against said at least one bumper contact element causes said at least one bumper frame member to pivotably rotate from said second rotatable position to said first reset position, thereby moving said self-closing hanging system to a closed position of said self-closing hanging system; and a bumper hanging assembly comprising pairs of support members extending downwardly from a support arm attached to said base support member, wherein said entrance member extends between said pairs of support members;

a cross beam member extending perpendicularly between a respective pair of said support members, wherein said fulcrum is located on said cross beam member; and a plurality of apertures located on said support members, wherein a fastening structure is inserted through a respective pair of said apertures, securing said respective pair of said support members together, with said support beams disposed there between.

12. The self-closing hanging system of claim 11, wherein said at least one base support member comprises an upright support post, a post member concentrically disposed within said upright support post, and a bearing arrangement positioned between said upright support post and said post member.

13. The self-closing hanging system of claim 12, wherein said bearing arrangement is: a linear bearing; a plain bearing; a rolling element bearing; a jewel bearing; or a fluid bearing.

14. The self-closing hanging system of claim 12, wherein said bearing arrangement comprises three linear bearings, offset within said upright support post by a plurality of spacers.

15. The self-closing hanging system of claim 12, wherein said hinge bearing structure has a rigid support strut fixedly attached to said upright support post, a pair of linear ball transfer bearings fixedly attached to said rigid support strut, wherein said rigid support strut has longitudinally extending frame bars forming a dihedral angle about a central surface, said pair of linear ball transfer bearings fixedly attached to said longitudinally extending frame bars.

16. The self-closing hanging system of claim 15, wherein said upright support post is filled with a fluid.

17. A self-closing hanging system comprising:

an entrance;

a base support member serving as an outer frame element for said self-closing hanging system located at one side of said entrance, in which said base support member has a central cavity depending through said base support member and a cam surface along an outer peripheral surface of one end of said base support member;

an entrance member comprising one or more support beams pivotably mounted to said base support member about a hinge bearing structure, wherein said hinge bearing structure is capable of regulating a time of travel of said entrance member between open and closed position of said self-closing hanging system;

a bumper assembly comprising a first bumper frame member attached to a fulcrum, a first bumper contact element capable of independent axial rotation in relation to said first bumper frame member, a second bumper frame member attached to said entrance member fulcrum, a second bumper contact element capable of independent axial rotation in relation to said second bumper frame member, wherein said first bumper frame member and said second bumper frame member exist as a contiguous assembly, forming a lever capable pivoting about said fulcrum;

a counter-balance assembly, which resets said bumper assembly perpendicular to said entrance member surface member when a force is removed from said bumper assembly;

wherein application of said force against said at least one bumper contact element pivotably rotates said at least one bumper frame member about said fulcrum from a first reset position to a second rotatable position thereby moving said self-closing hanging system to an open position of said self-closing hanging system; and wherein removal of said force against said at least one bumper contact element causes said at least one bumper frame member to pivotably rotate from said second rotatable position to said first reset position, thereby moving said self-closing hanging system to a closed position of said self-closing hanging system; and a bumper hanging assembly comprising pairs of support members extending downwardly from a support arm attached to said base support member, wherein said entrance member extends between said pairs of support members;

a cross beam member extending perpendicularly between a respective pair of said support members, wherein said fulcrum is located on said cross beam member; and a plurality of apertures located on said support members, wherein a fastening structure is inserted through a respective pair of said apertures, securing said respective pair of said support members together, with said support beams disposed there between.

* * * * *